United States Patent [19]

Krouse

[11] 4,109,231

[45] Aug. 22, 1978

[54] PORTABLE SWITCH AND DIMMER CONTROL CONSOLE

[76] Inventor: Robert S. Krouse, 2316 Manning St., Philadelphia, Pa. 19103

[21] Appl. No.: 780,921

[22] Filed: Mar. 24, 1977

[51] Int. Cl.[2] ..... H01C 10/50

[52] U.S. Cl. ..... 338/200; 307/114; 338/119; 338/172; 338/201

[58] Field of Search ..... 338/119, 196, 200, 172, 338/201, 220, 221; 200/51 R; 315/194; 307/113, 114, 115

[56] References Cited

U.S. PATENT DOCUMENTS

| | | | |
|---|---|---|---|
| 2,469,924 | 5/1949 | Kunz, Jr. | 338/119 |
| 2,504,873 | 4/1950 | Porter | 338/119 |
| 2,907,855 | 10/1959 | Hedges | 200/51 R X |
| 3,324,260 | 6/1967 | Schumacher | 200/51 R |
| 3,935,505 | 1/1976 | Spiteri | 315/194 |

FOREIGN PATENT DOCUMENTS

| | | | |
|---|---|---|---|
| 506,760 | 9/1930 | Fed. Rep. of Germany | 338/220 |
| 514,750 | 11/1939 | United Kingdom | 338/220 |

*Primary Examiner*—C. L. Albritton
*Attorney, Agent, or Firm*—Weiser, Stapler & Spivak

[57] ABSTRACT

A portable switch and dimmer control console for conveniently controlling a plurality of electrical devices and variably controlling the intensity of at least one fixture in a single conveniently designed self-contained portable unit.

14 Claims, 2 Drawing Figures

PORTABLE SWITCH AND DIMMER CONTROL CONSOLE

BACKGROUND OF THE INVENTION

The present invention relates generally to the field of portable electric current control devices, and more particularly to a self-contained console having a plurality of electrical fixture control means and at least one variably resistant fixture control means.

Various types of in-line electrical switch devices and portable distribution control units have been developed by prior workers in the art. Additionally, means for variably controlling the intensity of lighting fixtures, such as by employing dimmer switches, has been disclosed. Each of these has provided a variation in the art but has generally been incorporated in permanently installed apparatus having no portability features.

Lighting intensity control devices have generally been designed as fixed position units which have been recessed into wall outlet boxes, thereby replacing conventional lighting switch units. It has also been known to provide a variable lighting intensity control apparatus which is adapted to be connected in electrical wire means between a source of electrical power and an incandescent lamp. Such intensity control devices have also been developed in combination with a switch for the light which is controlled. The prior art "dimmer" controls have not been combined with other controlled devices or circuits in a portable unit, but have been mechanically and electrically engaged in relatively permanent fashion with but a single lighting fixture.

Portable distribution units for electrical control of interchangeable electrical appliances have in the past principally involved little more than a conductive cord extension from a wall outlet to a receptacle means having a plurality of female plug receptacles for interchangeable association with various electrical appliances. It has however been provided that the receptacle means incorporate means whereby the connected devices may be individually controlled from a single remote point. Devices having various functions in the field are referred to in the patent literature.

In U.S. Pat. No. 3,184,618, there is disclosed an electrical current control apparatus including a housing having wire engaging means. A magnetic core is provided with a terminal connected to a conductive member to mechanically and electrically connect wires inserted at either end of the housing through the windings of the magnetic core. The device including the core, its windings and a conductive rotatable membrane effectively comprise a current controlling means whereby dimmer control of lighting fixtures is accomplished. This apparatus is relatively permanently incorporated in a conductive electrical cable associated with a single lighting fixture.

The device disclosed in U.S. Pat. No. 2,674,701, shows a self-contained electrical control unit which receives power from a conventional wall receptacle to energize casing components of the control unit. A receptacle for receiving the plug associated with the cord of a single electrical apparatus such as an air conditioner is included. The circuit between the cord leading to the line current source and to the electrical apparatus has been cut to provide receptacles into which a thermostat timer, a remote control switch or other electrically operated devices may be connected. U.S. Pat. No. 2,835,830 shows a premanently installed, remote control device for electrical appliances wherein power is supplied through a plug adapted to accept ordinary line current. The face plate of the remote control device is provided with four manual switches, a pilot light and a night light. Outlets are provided on the housing of the device for insertion of ordinary wall plugs.

In U.S. Pat. No. 2,988,655, there is disclosed a remote control, portable distribution box comprising generally a plurality of power input terminals and power output terminals. A remote control unit is provided which contains a plurality of push button switches for controlling the various input and output terminals. U.S. Pat. No. 2,979,624, shows a remote control extension including a multiple outlet box in combination with a switch panel box. A plurality of push button switches are employed to control the outlets contained within the outlet box. U.S. Pat. Nos. 3,287,722, 3,334,250, and 3,514,626 further show the state of the art and show other methods of remotely controlling receptacle outlets.

As can be seen from the foregoing discussion, the general concept of employing portable, remote devices, to control a plurality of circuit outlets is known to those skilled in the art. Despite the teaching of these references, the convenience provided by a portable console making possible the interchangeable connection of various appliances in combination with variable lighting intensity control means has remained an unsatisfied need.

SUMMARY OF THE INVENTION

The present invention relates generally to a portable switch and dimmer control console and more particularly to a portable, self-contained console incorporating electric current control circuitry including a plurality of individual fixture control circuits for activation of electrical fixtures and at least one variable resistant control circuit for infinitely variable control of current flow to fixtures such as incandescent lamps.

The control console of the present invention comprises a casing having upper and base portions which may be associated through a casing junction or which may be of unitary construction. Within the casing is provided electrical current control means of novel circuit design. Manual control means, such as switches and dimmer dials are provided on a panel in the upper portion of the casing to control a plurality of electrical devices such as room lighting, electrical heat, radios, appliances, etc. from a single position. The console may be fabricated of molded plastics or other materials having electrical insulating properties such as "thermo" setting resins or any other suitable material.

Associated with the console, as an integral part thereof and separated therefrom by a length of conventional electrical insulated cord, are means for interchangeable electrical engagement of fixtures, including a receptacle box having a plurality of receptacles for receiving male contacts of the plug connectors of various appliances and fixtures. It is contemplated that appliances such as televisions, radios, stereos, digital clocks, telephone answering devices, intercom systems and the like may be interconnected through the receptacles provided. Further, incandescent lights, electric heat and other electrical devices of variable intensity may be controlled by variably resistant fixture control circuits incorporated in the console. Also, time delayed switch means may be incorporated for purposes of predetermining activation times of selected appliances among those controlled. The console can be designed for desk or night table top use or as a floor model or other portable embodiment.

The novel circuit of the present control system essentially comprises a plurality of individual fixture control circuits in parallel with at least one control circuit wired for infinitely variable resistance. Each individual and variably resistant fixture control circuit can contain a small lamp or other source of illumination incorporated within the body of the switch handle. Dimmer dials in the control panel may also be designed as to be translucent, thereby making visibility in low light possible. Electrical connection from the receptacles of the receptacle box to the various individual circuits of the overall circuit system may be through an electrical connecting wires.

It is therefore an object of the present invention to provide an improved portable switch and dimmer control console for use in the home or office.

It is another object of the present invention to provide a novel portable switch and dimmer control console for application as a central control for electrical devices.

It is another object of the present invention to provide a novel combination of appliance switch control and lighting intensity control in a portable console capable of using conventional current sources.

It is another object of the present invention to provide a portable central control console for control of a broad spectrum of large and small consumer and industrial electrical appliances from a single base station.

It is another object of the present invention to provide a novel circuit system for incorporating the control of various electrical devices and appliances into a unitary circuit structure.

It is another object of the invention to provide a portable switch and dimmer control console that is inexpensive in manufacture, compact in design, and efficient when in use.

Other objects and a fuller understanding of the invention will be had by referring to the following description and claims drawn to a preferred embodiment thereof, taken in conjunction with the accompanying drawings, wherein like reference characters refer to similar parts through the several views, and in which:

DESCRIPTION OF THE PREFERRED EMBODIMENTS OF THE INVENTION

Figure 1:
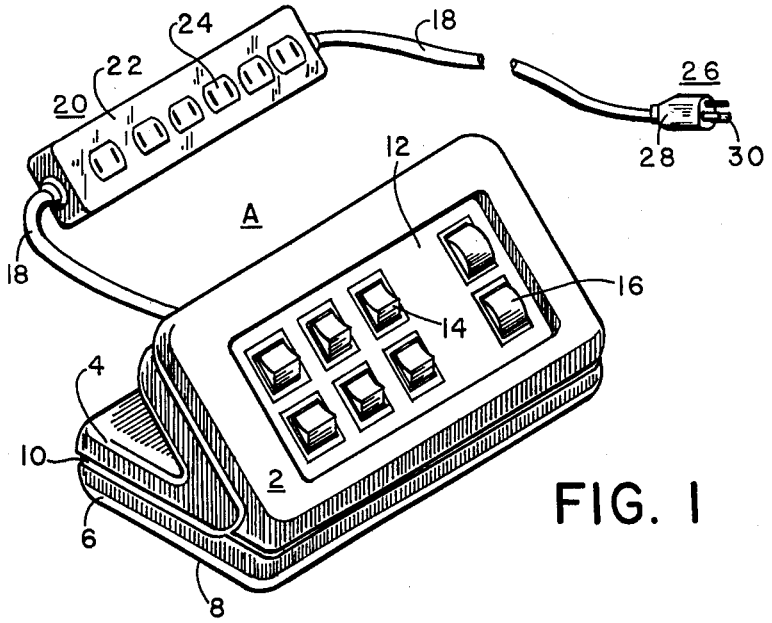
FIG. 1 is an isometric view of a preferred embodiment of the portable switch and dimmer control console of the present invention.

Although specific terms are used in the following description for the sake of clarity, these terms are intended to refer only to the particular structure of the invention selected for illustration in the drawings, and are not intended to define or limit the scope of the invention.

As shown in the drawings, the portable switch and dimmer control console generally designated A essentially comprises a casing 2 which incorporates a control panel 12 in the upper portion 4 of said casing 2. A novel control circuit, generally designated B, includes portions mounted within the casing 2 such as the various controls 14, 16 which project through the control panel 12. The casing 2 is fabricated from electrical insulating material having a relatively firm body such as polymeric plastic, thermosetting plastic or other suitable material. The various control means are designed to be translucent, thereby permitting elements of the control circuit to enhance visibility in low light.

Referring now to FIG. 1, the casing 2 is illustrated as a unitary member having an upper portion 4 and a base portion 6, in angular relationship, said base portion 6 having a bottom surface 8 which is adapted to rest on a table or desk surface (not shown). The casing 2 may be of unitary molded construction or may have the upper portion 4 and the base portion 6 joined by fastening means along the casing junction 10.

The control panel 12 is incorporated in the external surface of the upper portion 4 and thus is postured at an angle enhancing convenience of use. The control panel in a preferred embodiment, is a continuous molded portion of the upper portion 4. Switch operating means 14 which may be toggle type switch handles are provided in the control panel 12 for mechanically activating and deactivating the various individual fixture control circuits of the control circuit system B. For a preferred embodiment, dimmer dials 16 are provided in the control panel 12 for infinitely variable control of one or more fixtures associated with the variably resistant fixture control circuits.

Connected with the control console A through a coventional insulating electrical cord 18 is a receptacle box 20 having a plurality of conventional two contact receptacles 24 incorporated in the receptacle box housing 22 so as to be accessible for the insertion of plugs from various appliances. The receptacles 24 each receive the male contacts of a plug connector of various appliances and fixtures (not shown) for electrical interconnection with the circuitry of the portable control console A. At the opposite end of the receptacle box 20 is a continuation of the conventional insulated electrical cord 18 which terminates in the plug connector 26 comprising a shell 28 and the extending contacts 30 for insertion into a usual wall outlet for electrical energization with a conventional 110 volt line current.

Figure 2:
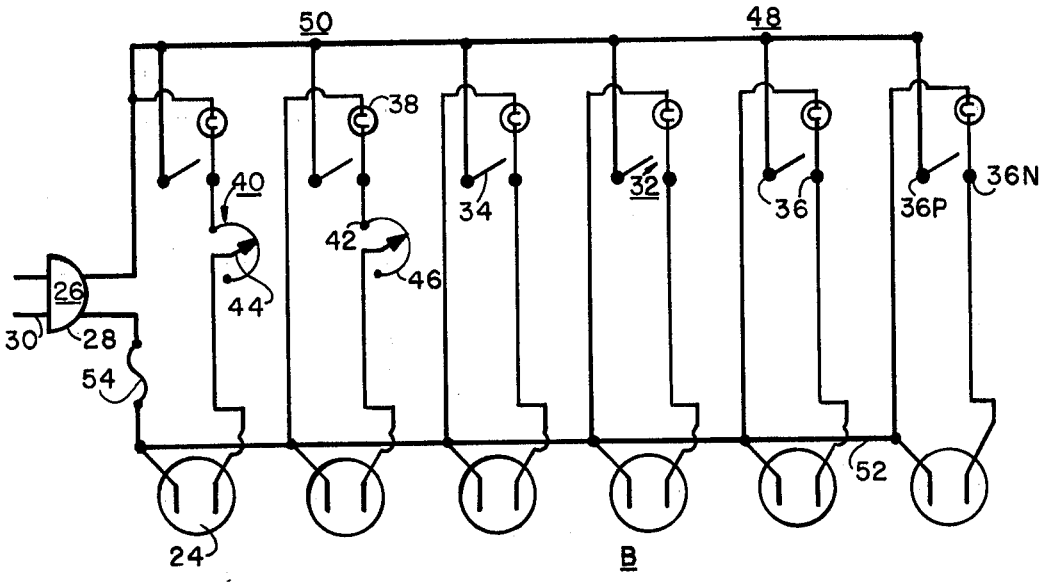
FIG. 2 is an electrical schematic diagram of the novel circuit of the present invention.

Referring now to FIG. 2, the control circuit B is illustrated comprising a plurality of individual fixture control circuits 48 in parallel with a plurality of variably resistant fixture control circuits 50. The circuits 48, 50 each draw current from the source of conventional 110 volt line current through an electrically conductive circuit line 52 common to each of the individual circuits. In line on the common line 52 is a fuse 54 of rated value to open before the current reaches a level which would injure the principal elements of the circuit.

Each of the individual fixture control circuits 48 comprises a small incandescent lamp or other known type of illumination 38, the light emitting potential of which is sufficient to illuminate through the translucent material of the switch operating means 14. Particularly when the ambient light is of sufficiently low intensity, the glow of the lamps 14 facilitate manual function of the device. In series with the incandescent lamp 38 is the negative contact 36N of a knife switch 32 consisting of a switch blade 34 and contacts 36. The positive contact 36P is hingedly connected with the switch blade 34. The negative contact 36N is positioned to be selectively contacted by the blade 34 so as to complete the circuit 48 upon activation by the switch operating means 14.

The variably resistant fixture control circuits 50 essentially comprise an incandescent lamp 38. the light emitting potential of which is determined as indicated above, in series with a rheostat 40 by connection with its fixed terminal 42. The movable contact 44 is adjusted in position along the length of a resistant element 46 by mechanical manipulation of the dimmer dials 16 which are affixed on the control panel as described above.

The rotation of the dimmer dials 16 mechanically manipulates the position of the movable contact 44 so as to vary the impedance created by the rheostat 40 from a minimu, where the resistance can be no greater than that of a "short-circuit" line to a maximum which is limited only by the total resistance of the resistance element 46. Thus, the illumination intensity of the lighting appliance control can be varied from an "off" position, representing maximum impedance, to a fully "on" position, representing only that impedance which would be created by a closed knife switch of the same construction.

The control circuit B incorporates the receptacles 44 of the multiple receptacle box 20, one contact of each receptacle being connected to the common wire 52 and the other contact being in series contact with the downstream contact of the individual fixture control circuit or the variably resistant fixture control circuit as the case may be. The control circuit is connected to a coventional 110 volt line current source by a conventional plug connector means having suitable contacts as described above. The design of the circuit and the number of receptacles is limited only by the requirement that it not incorporate so many individual circuits to overload the line current provided.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A portable switch and dimmer control for controlling a plurality of electrically energized devices which comprises:

a casing;

control means mounted on said casing to manually control devices; and an electrical control circuit operated by said control means, said control circuit comprising a plurality of individual fixture control circuits, at least one variably resistant fixture control circuit, and means for interchangeable electrical engagement of fixtures with said control circuit, wherein at least some of the individual fixture control circuits and the variably resistant fixture control circuit are connected in parallel.

2. The portable switch and dimmer control of claim 1 wherein the individual fixture control circuits include switch means.

3. The portable switch and dimmer control of claim 1 wherein the variably resistant fixture control circuit includes a rheostat.

4. The portable switch and dimmer control of claim 1 wherein the portable casing has an upper and lower portion, and wherein the lower portion serves as a base to support the control means.

5. The portable switch and dimmer control of claim 4 wherein the upper portion of the portable casing comprises a control panel for the manual control means.

6. The portable switch and dimmer control of claim 5 wherein the means for interchangeable electrical engagement of the fixtures is incorporated in the casing.

7. The portable switch and dimmer control means of claim 1 wherein the means for interchangeable electrical engagement of the fixtures is connected to the casing by an electrical cord.

8. The portable switch and dimmer control of claim 1 wherein the casing is fabricated of electrically insulating material.

9. The portable switch and dimmer control of claim 1 wherein the manual control means associated with the individual fixture control circuits comprise switch operating means.

10. The portable switch and dimmer control of claim 1 wherein the manual control means associated with the variably resistant fixture control circuit comprise a dimmer dial.

11. The portable switch and dimmer control of claim 9 wherein the switch operating means comprise a translucent portion.

12. The portable switch and dimmer control of claim 10 wherein the dimmer dial comprises a translucent portion.

13. The portable switch and dimmer control of claim 11 wherein each individual fixture control circuit includes a source of illumination associated with the switch operating means whereby the source can be viewed through the translucent portion.

14. The portable switch and dimmer control of claim 12 wherein each variably resistant fixture control circuit includes a source of illumination associated with the dimmer dial whereby the source can be viewed through the translucent portion.

* * * * *